United States Patent [19]

Seidler et al.

[11] Patent Number: 4,778,231

[45] Date of Patent: Oct. 18, 1988

[54] ELECTRICAL CONNECTOR

[75] Inventors: Jack Seidler, Flushing, N.Y.; Robert N. Taylor, Coventry, R.I.

[73] Assignee: North American Specialties Corp., College Point, N.Y.

[21] Appl. No.: 778,375

[22] Filed: Sep. 20, 1985

Related U.S. Application Data

[63] Continuation-in-part of Ser. No. 656,137, Sep. 28, 1984.

[51] Int. Cl.[4] ..... H01R 13/05

[52] U.S. Cl. ..... 439/857; 439/295; 439/849; 439/858; 439/862; 439/886

[58] Field of Search ..... 339/17 L, 47, 49, 176 MP, 339/252 R, 278 C, 258 R, 258 P

[56] References Cited

U.S. PATENT DOCUMENTS

| | | | |
|---|---|---|---|
| 2,744,244 | 5/1956 | Schumacher et al. | 339/47 R |
| 3,140,907 | 7/1964 | Davies | 339/217 S |
| 3,218,599 | 11/1965 | Winkler | 339/47 R |
| 3,585,573 | 6/1971 | Robshaw | 339/176 MP |
| 3,808,578 | 4/1974 | Hansen | 339/59 M |
| 4,018,495 | 4/1977 | Freitag | 339/17 L |
| 4,487,471 | 12/1984 | Freshwater et al. | 339/99 R |

FOREIGN PATENT DOCUMENTS

| | | | |
|---|---|---|---|
| 3242635 | 9/1983 | Fed. Rep. of Germany | 339/258 R |

*Primary Examiner*—Joseph H. McGlynn
*Attorney, Agent, or Firm*—Darby & Darby

[57] ABSTRACT

An electrical connector includes two assemblies which are adapted to mate. Each assembly has a number of contacts mounted thereon. The respective contacts (which may be pins and resilient tongues, or hermaphroditic contacts) include separate bearing surfaces and electrical contacting portions. The bearing surfaces of the contacts are subject to the abrasive action when the connector assemblies are being coupled or uncoupled, while the electrical contacting portions are protected from abrasion and contact one another only when the two assemblies are substantially coupled together.

10 Claims, 6 Drawing Sheets

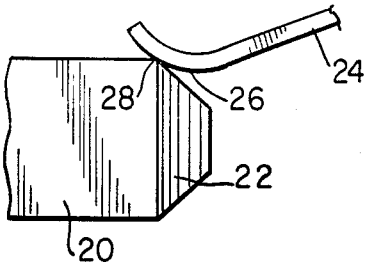
FIG. 1
PRIOR ART
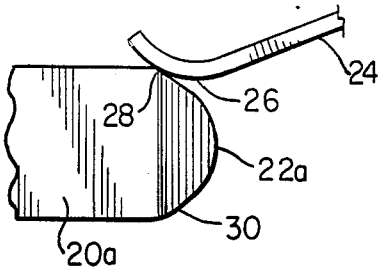
FIG. 2
PRIOR ART
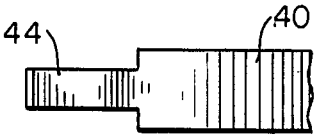
FIG. 4
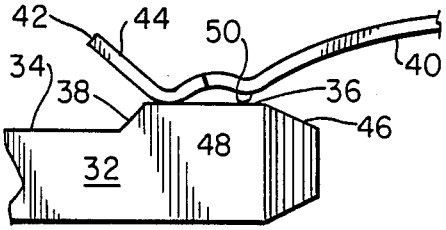
FIG. 3
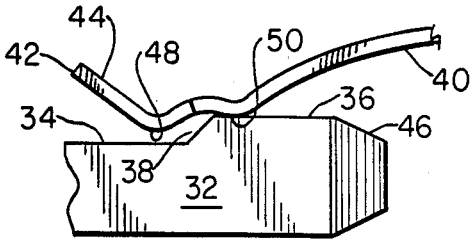
FIG. 5
FIG. 8
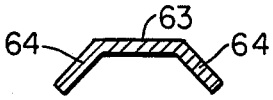
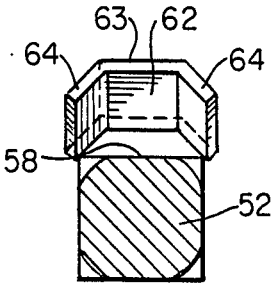
FIG. 7
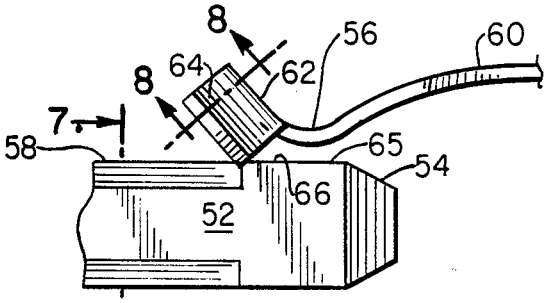
FIG. 6

ELECTRICAL CONNECTOR

CROSS REFERENCE TO RELATED APPLICATION

This is a continuation-in-part of application Ser. No. 656,137, filed Sept. 28, 1984.

BACKGROUND OF THE INVENTION

1. Field of the Invention

This invention relates to electrical connectors, and more particularly relates to improvements in the design of contacts for use in electrical connectors.

2. Description of the Prior Art

Many electrical connectors currently on the market include a pair of assemblies which cooperatingly mate to provide an electrical conductive path through the connector. One assembly of the connector may include one or a number of conductive pins or posts (generally called pins). Each pin is mounted at one end in the assembly (generally called a plug or pin connector) in a variety of different ways; the other end of each post is free standing. The other assembly of the connector includes one or a number of conductive resilient arms or leaves (generally called contacts), each contact corresponding to a pin of the pin assembly. The resilient contacts also are mounted in their receptacle assembly with one end of each contact free.

The pins and resilient contacts of the two assemblies are aligned so that, when the two assemblies of the connector are coupled together, each pin engagingly contacts the corresponding resilient contact.

Each resilient contact is biased by its resilience to assert sufficient contact pressure on the outer surface of its mating pin. Typically, the contacts are positioned in their rest state to extend partially into the axial path of the pins when the two connector assemblies are aligned but not yet coupled. The pins deflect the resilient contacts as the two connector assemblies are joined together, so that the resilience of the contact presses it against the mating pin post. This ensures a proper electrical path through the mating contacts of each connector assembly.

One of the problems with the conventional connectors having the structure described above is that their useful life is limited in the number of connecting and disconnecting operations due to premature contact wear. This problem has especially manifested itself in applications where gold, platinum, iridium, rhodium or other noble or precious metals are suitably placed or coated (as by plating, rolling, filling, layering or the like) on electrical contact-making surfaces of the pins and resilient contacts, in order to make the connector more immune to corrosion and other environmental conditions and to reduce the electrical resistance of the pin-to-contact connection. The coated contact surfaces of the pins and resilient contacts may eventually be abraided by the sliding engagement of the contacts, and worn away as the connector is repeatedly connected and disconnected. This leaves the untreated undermaterial of the contacts exposed, so that they may corrode and result in an impaired conductive path through the connector, rendering the connector unacceptable for use after a shorter-than-desired connect/disconnect cycle life.

One way to extend this cycle life is to use a thicker layer of noble metal. However, this is undesirable because of the consequent substantial increase in material costs.

OBJECTS AND SUMMARY OF THE INVENTION

It is an overall object of the present invention to provide a connector which has an extended connect-/disconnect cycle life, for a given noble metal coating, and permitting substantial cost saving by reducing the noble metal material required for a given cycle life.

It is a more specific object of the present invention to provide an improvement in the design of contacts for an electrical connector, permitting the contacts to have coated oontact-making portions which are not worn away by repeatedly connecting and disconnecting the mating assemblies of the connector.

It is another object of the present invention to provide such a connector which can be cost-effectively manufactured by conventional means.

The objects of the present invention are met by following two basic concepts in the design of the mating contacts of the connector. First, the connection making surfaces of the contacts which are in contact when the mating connector portions are coupled together (which are usually coated with noble metal) are separated from the surfaces which rub over one another as the connector assemblies are being connected or disconnected. Second, the mechanical action of the contact is separated from its electrical action.

In accordance with the present invention, an electrical connector includes two assemblies which are adapted to mate cooperatively. Each assembly includes a housing mounting one or a number of electrical contacts The contacts of one assembly may be in the form of substantially rigid pins, which may be mounted in a housing. The contacts of the other assembly are then formed by resilient leaves or tongues, which also may be mounted in an appropriate housing. Where desired, both sets of contacts may be in the form of resilient tongues urged toward one another when coupled.

The contacts of one assembly are designed to be aligned with corresponding contacts of the other assembly so that when the two connector assemblies are coupled together, the corresponding contacts engage one another and provide electrical paths through the connector.

Each of the mating contacts includes a rubbing or bearing section and an electrical contacting portion. These are so situated that the bearing sections of a mating pair of contacts, but not their electrical contacting portions, come in contact when the connector is actually in the process of being connected or disconnected. Only when the connector assembly has been substantially fully coupled together do the electrical contacting portions of each mating pair of contacts engage-one another.

Thus, it can be seen that the bearing portions of the contacts protect the electrical contacting portions from undue wear and abrasion which might be caused by the repeated connecting and disconnecting of the connector.

It is envisioned to be within the scope of this invention that the contacts of each connector assembly can take on various shapes and sizes. Also, the bearing portion and electrical contacting portion of each contact may be situated in various positions on the contact so that they cooperatively engage the corresponding bearing portion and electrical contacting portion of a mating contact.

Preferred forms of contacts, as well as other embodiments, objects, features and advantages of this invention, will be apparent from the following detailed description of illustrative embodiments thereof, which is to be read in connection with the accompanying drawings.

BRIEF DESCRIPTION OF THE DRAWINGS

FIG. 1 is a fragmentary side elevation view of a pair of conventional contacts.

FIG. 2 is a fragmentary side elevation view of a pair of conventional contacts similar in many respects to those illustrated in FIG. 1.

FIG. 3 is a fragmentary side elevation view of an electrical connector in accordance with one embodiment of the present invention, at a position during engagement of the contacts.

FIG. 4 is a fragmentary plan view of one of the contacts illustrated in FIG. 3.

FIG. 5 is a side elevation view of the contacts shown in FIG. 3, illustrating the interaction of the contacts at final engagement in accordance with the present invention.

FIG. 6 is a fragmentary side elevation view of a pair of electrical contacts formed in accordance with a second embodiment of the present invention, the contacts being only partially engaged.

FIG. 7 is a sectional view of the embodiment shown in FIG. 5 viewed along line 7—7 of FIG. 5.

FIG. 8 is a sectional view of one of the contacts illustrated in FIG. 6, taken along line 8—8.

Detailed Description of the Preferred Embodiments

Figure 10:
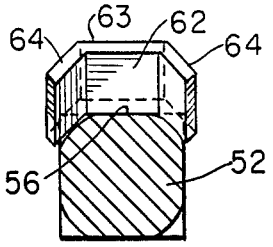
FIG. 10 is a sectional view of the embodiment shown in FIG. 9 taken along line 10—10 of FIG. 9.

A conventional pair of contacts for use in an electrical connector is illustrated in FIGS. 1 and 2. A typical connector includes a first assembly and a second assembly which are adapted to be coupled together. The first assembly includes one or a number of pins (one being shown at 20) which are usually mounted on or in an insulating housing and project outwardly to expose a free-standing end 22.

The second assembly includes one or a number of resilient contacts in the form of flat leaves or tongues (one being shown at 24) usually mounted on or in an insulating housing. The resilient contacts 24 may extend outwardly from the housing of the connector or be contained in it, so that one end of each resilient contact is at or faces an open end of the housing, and is free to move transversely.

It should be noted that the resilient leaf 24 extends into the axial path of the pin 20 so that the pin 20 deflects the resilient tongue 24 when the two assemblies of the connector are coupled together. This insures that the resilient contact and the pin remain in contact with each other to provide an electrical path through the connector.

As explained previously in this description, one of the disadvantages of the arrangement shown in FIG. 1 is that the bottom or contacting surface 26 of the resilient contact 24 and the top or contacting surface 28 of the pin 20 rub on one another as the pin and contact are mated, so that they may be unduly worn as their surfaces slide against one another whenever the connector assemblies are joined or uncoupled. This wearing action is exacerbated by the pressure exerted between the pin 20 and contact 24 because of the resilience of contact 24, necessary to maintain good electrical connection after full engagement. This mechanical sliding action can abraid the surfaces of the pin and resilient contact including the surfaces which abut when the assemblies are fully engaged. These surfaces are usually covered in known manner with a thin layer of a noble metal (e.g., gold, rhodium, iridium, platinum, etc.) to prevent corrosion and to provide good electrical interconnection. Because of the expense of these noble metal materials, only an exceedingly thin layer is used However, the abrasive action just described wears away the noble metal, to a point where the effectiveness of the connector is impaired. The connect/disconnect cycle life of the connector is determined primarily by the wearing away of the noble metal coating. Thus, after the connector has been repeatedly disconnected and reconnected a number of time, it may become ineffective and have to be replaced.

This is a common occurrence when the pin 20, as illustrated in FIG. 1, has a sharp transition 28 between the shank 20 and the beveled surface of the tip 22. This sharp transition or edge can quickly abraid the coated surfaces of the resilient contact.

One way of partially dealing with this problem is illustrated in the embodiment of FIG. 2. The pin 20*a* is formed with a rounded continuous transition 30 beween the shank and the tip 22*a*. Thus, in this form, there is no sharp edge on the pin 20*a* to scrape the surface of the resilient contact 24. However, this modification of the pin still results in undesirable abrasion of the surfaces of the pin and resilient contact, leading to premature termination of useful life of the connector.

These disadvantages have been overcome by the design of the present invention. According to the invention, the connector includes mating contacts, with each contact having a rubbing or bearing portion and an electrical contacting portion separated from the bearing portion. The bearing portion takes up the abrasion resulting from the repeated coupling and uncoupling of the connector assemblies. The electrical contacting portions of each mating pair of contacts are prevented by the bearing portion from contacting either the bearing portion or the electrical contacting portion of a mating contact, until the two assemblies of the connector are substantially fully coupled together, whereupon the electrical contacting portions engage each other resiliently to provide an electrical path through the connector. Thus, the surfaces of the electrical contacting portions of the contacts are not worn away by the mechanical action of connecting or disconnecting the connector.

Referring now to the embodiment shown in FIGS. 3–5 of the drawings, it will be seen that the electrical connector in accordance with this embodiment of the present invention includes a first assembly and a second assembly, each having mounted thereon at least one electrically conductive contact. The first assembly includes a number of pins 32. Each pin 32 is shown as having a square cross-sectional shape, although the present invention will apply equally as well with a pin having a round or other cross-sectional shape. Each pin 32 is formed with a recessed surface on one side thereof to define a depression 34 where the pin has a reduced dimension. The outer surface 36 of the pin 32 may descend abruptly into this recess 34, or more preferably, may be joined with the recess 34 surface through a sloped portion 38. The recess 34 of the pin 32 is formed on the shank of the pin, as shown, and spaced inwardly from the tip. The recess 34 may extend completely to the base of pin 32 (not shown) or only partially.

The second connector assembly includes a number of resilient contacts or tongues, one being shown at 40. Each resilient tongue 40 includes a free end 42 which projects into the axial path of a corresponding pin 32 of the first assembly. The end 44 of resilient contact 40 is sloped generally as shown and engages a tapered portion 46 of pin 32. By a type of camming action, as the pin 32 is inserted into the resilient contact assembly, the resilient contact 40 is displaced upward, in cantilever fashion, against it resilient force, to create a pressure between pin 32 and the resilient contact 40. In this way, each pin 32 will engage and deflect the mating resilient tongue 40 to ensure positive contact between the two when the connector assemblies are coupled together.

The resilient contact 40 is formed with a pair of ridges or wavy crests 48, 50 on its bottom or contacting surface. These may be formed by conventional means, such as precision progressive stamping, to form the downwardly extending wavy crests acting as ridges. The first ridge or crest 48, located nearest the tip 44 of the resilient contact 40, acts as a rubbing or bearing surface to protect the second ridge 50, which is positioned more inwardly from the end 44 of the resilient contact 40.

Because the end 44 of the resilient contact 40 extends into the axial path of the pin 32, when engaging the connector assemblies, the tapered end 46 of pin 32 will first engage the sloped end 44 of contact 40, causing contact 40 to bend in cantilever fashion, until the first crest 48 bears on the top surface 36 of pin 32. Upon further engagement, the first ridge 48 will ride up on the tapered tip of the pin 32 and slide along the outer surface 36 of the pin 32. The second crest or ridge 50, which is further up on the resilient contact, remains off the surface 36 of the pin 32 during this engagement. Thus, all of the rubbing and abrasion will occur between the bearing surface of the first ridge 48 and the top surface 36 of pin 32.

As shown in FIG. 5, the pin 32 and the mating resilient contact 40 are designed so that the first ridge 48 is received in the depresion 34 of the pin 32 when the two contacts or assemblies are fully engaged. The depth of the depression 34 is chosen so that before the first ridge 48 touches the pin surface in the depression 48, the second ridge 50 will contact the surface 36 of the pin 32. Thus, as the first ridge 48 falls into the depression 34, the second ridge 50 drops down to contact the outer surface 36 of the pin 32 without sliding substantially along the outer surface 36. The second ridge portion 50 therefore serves as the electrical contacting portion of contact 40. However, the surface of the resilient contact 40 located at the second ridge 50 experiences little wear such as is normally associated with the coupling and uncoupling of the connector assemblies. Hence, this electrical contacting portion 50 may be coated with precious or noble metal without being subject to undesired abrasion. For economy, the remainder of contact 40 need not be so coated. Also, only the portion of the pin 32 opposite the ridge 50, when fully engaged, need be coated, and the remaining portion of the pin shank need not be, resulting in further economy.

In the embodiment just described, the contact 40 is a thin strip of resilient conductive material, such as phosphor bronze, longitudinally rectangular in shape. The first and second ridges 48,50 may extend across the entire width of the strip forming the contact 40. It will be understood that the coating of but a small portion of these contacts 32,40 may readily be accomplished by rolling a narrow ribbon of noble metal onto the contact blank (which may be of phosphor bronze) before forming the contacts, as in a multiple and progressive stamping operation, as is well known.

Although the coated surface located at second ridge 48 is protected from wear by the action of the first ridge 50, the outer surface 36 of the pin 32, which also acts as an electrical contacting surface, may be worn away by rubbing action of the first ridge 48.

To avoid this, it is preferred that the resilient contact 40 be formed in the shape shown in plan view in FIG. 4, having the camming end portion 44, including the first ridge 48, and narrower than the remaining portion of the resilient contact, including the second ridge 50 forming the electrical contacting surface.

A resilient contact with this configuration will only abraid a small center strip on the outer surface 36 of the pin 32; the rest of the outer surface 36 of the pin 32 will remain unaffected by the sliding action of the two mating contacts when the connector assemblies are being engaged. When the assemblies are fully engaged, the bottom surface of the second ridge 50 will rest on the unabraided portion of the outer surface 36 of the pin 32, to provide an effective long-life electrical path through the connector.

Although it is illustrated in FIG. 4 that the portion 44,48 of the resilient contact 40 is narrower in width than the portion which includes the second electrical contacting ridge 50, as an alternative the tip of the resilient contact 40 may be formed with a fork-like shape. With such a configuration, only the edge portions of the outer surface 36 of the pin 32 will be subject to wear; the central portion will remain unmarked and provide a good electrical contacting surface for the corresponding area of the resilient contact at the second ridge 50.

A second embodiment according to the present invention is illustrated in FIGS. 6–10. A square pin 52 has its edges tapered or bevelled or chamfered over a portion thereof spaced from the tip. Although all four edges can be thus chamfered to faciliate manufacturing the pin as illustrated in FIGS. 6–9, it is desirable that only two adjacent corners be so formed.

The resilient mating contact 60 extends into the axial path of the pin 52 as before. It includes a leading portion 62 at its free end which is concavely curved or bent downwardly in the direction of the pin (or has a segmented concave shape as illustrated in FIG. 8) to form two legs or depending edges 64. The leading portion 62 is sloped upwardly to serve as a camming surface in conjunction with the tapered tip 54 of pin 52, in a manner similar to contact end 44 and pin taper 46 of FIG. 3.

The resilient contact 60 further includes a curved portion 56 joining the main body of the resilient contact 60 and the leading portion 62. The curved portion 56 extends downwardly, with the lowest point of the legs 64 of the leading portion 62 beyond the main body portion in the direction of the pin 52.

The legs 64 of the leading portion 62 of the resilient contact preferably form an obtuse angle with its mid section 63, the angle being about 135° so as to be nearly parallel to the bevelled section of pin 52 when fully engaged. These legs 64 are separated at a distance which is sufficient to allow the leading portion 62 to ride on the unchamfered portion 66 of the pin 52, with the edges of the legs 64 in contact with the surface of pin 52 at its corners.

As illustrated in FIGS. 6 and 7, when the two connector assemblies are being coupled together, the edges of legs 64 of the leading portion 62 of the resilient contact 60 slide along the pin surface at its corners and form bearing surfaces. This keeps the curved portion 56 raised above the flat surface 65 of the pin 52. This prevents abrasive wear of the surface of the resilient contact in the area of the curved portion 56, and of the flat surface 65 of the pin 52 in the region 66 between the chamfered portion 58 and the tip 54.

Figure 9:
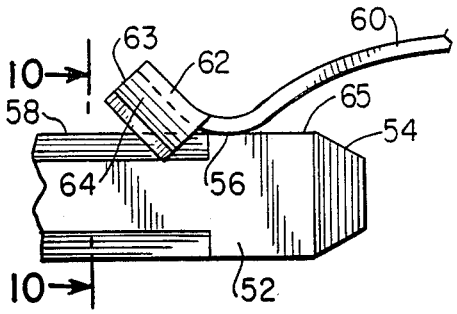
FIG. 9 is a side elevation view of the embodiment shown in FIG. 6, further illustrating the interaction of the two contacts, when fully engaged.
Figure 19:
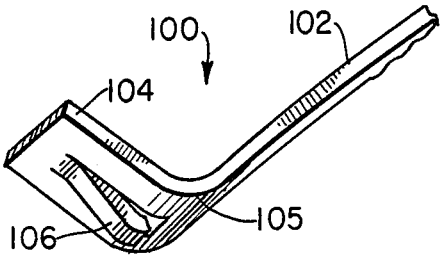
FIG. 19 is an isometric view illustrating the bottom of one of the contacts of a fifth embodiment in accordance with the present invention.

When the two connector assemblies have been fully engaged, the leading portion 52 of the resilient contact 60 is now located over the chamfered portion 58 of the pin 52. Because the corners of the pin 52 are chamfered, the two legs 64 of the contact leading portion 62 are no longer supported by the corners of the pin 52. The resilience of the contact 60 causes the curved portion 56 (which was previously raised above the surface of the pin) to drop into contact with the pin between the chamfered portion 58 and the tip 54, as illustrated in FIG. 9.

This arrangement has the advantage that the bearing surface of the resilient member 60 is formed by the edges of the legs 64, which creates a minimum area of rubbing between resilient member 60 and the cooperating bearing surface 66 of the pin member 52. Since the electrical contacting area of pin member 52 is on a portion of surface 66, this assures that a minimal portion of the pin contacting area will be abraided.

If desired, the mating of the contact members may be set so that on full engagement, the resilient member electrical contacting area is in contact with the flat portion of the pin chamfered section 58, which then is made the electrical contacting area of the pin.

Thus, the embodiment described above provides good electrical contacting surfaces on both the pin and resilient contact which are not worn or abraided by repeated coupling and uncoupling of the connector assemblies.

In this embodiment, it will be advantageous to coat with noble metal only the portion of the pin which is located between the chamfered portion 58 and the tip of the pin, and the area of the resilient contact at the curved portion 56. Economy is achieved by not coating the chamfered portion of the pin or the leading portion of the resilient contact, which are areas not relied upon to provide an electrical conductive path through the connector.

Conceptually similar alternative embodiments to that illustrated in FIGS. 6–10 are shown in FIGS. 11–18.

The pin contact 52' shown in FIGS. 11–14 is similar in structure to pin 52 of FIG. 6, in that it contains beveled edge portions 68 on at least the top surface 70 of the pin over a portion of the pin's shank set inwardly from the tip 72, the beveled edge portions thus providing the pin with removed and unremoved top surface areas.

Figure 11:
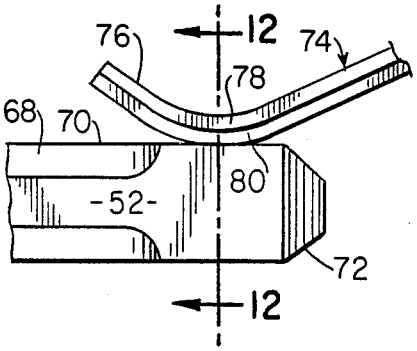
FIG. 11 is a fragmentary side elevation view of a pair of electrical contacts formed in accordance with a third embodiment of the present invention, the contacts being only partially engaged.
Figure 12:
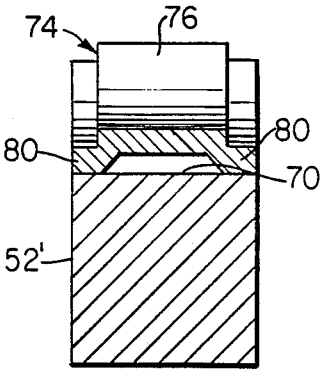
FIG. 12 is a fragmentary sectional veiw of the embodiment shown in FIG. 11 viewed along line 12—12 of FIG. 11.

A resilient leaf contact 74 is biased to engage the pin 52'. The leaf contact 74 includes a slightly curved free end 76 and is shaped in transverse cross-section over its entire length or at least over the curved free end to defie a mid-section 78 and a pair of depending legs 80 on opposite lateral sides of the mid-section 78. The legs 80 are displaced from the plane in which the mid-section 78 resides so that they ride on the unrecessed top surface 70 of the pin during initial engagement of the contacts, as illustrated in FIGS. 11 and 12, with mid-section 78 elevated from the top surface 70 of the pin.

Figure 13:
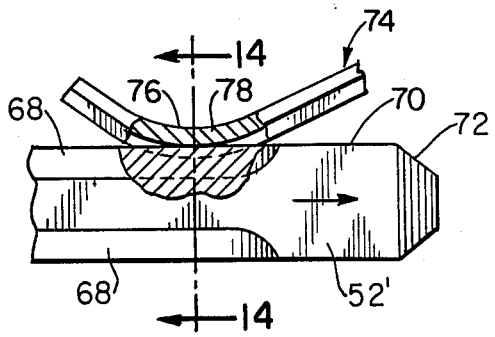
FIG. 13 is a side elevation view of the embodiment shown in FIG. 11, further illustrating the interaction of the two contacts, when fully engaged.
Figure 14:
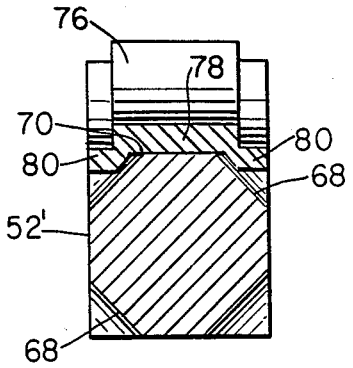
FIG. 14 is a sectional view of the embodiment of FIG. 11 viewed along the line 14—14 of FIG. 13.

The curved free end 76 of the leaf contact advances on the pin shank until it is situated over the beveled edge portions, as illustrated in FIGS. 13 and 14, at which position the leaf contact's mid-section 78 engages the top surface 70 of the pin between the beveled edges 68.

Another design is shown in FIGS. 15–18. The pin contact 82 has a recess 84 formed centrally in its top surface 86 over a portion set in from the tip 88 of the pin. The resilient leaf contact 90 includes a curved free end 92 formed with a downwardly projecting mid-section 94 and a pair of depending legs 96 joined to and raised above the mid-section 94. The bottom surface of the mid-section and the bottom surface of the legs constitute the bearing and electrical contacting surfaces of the leaf contact, respectively.

Figure 15:
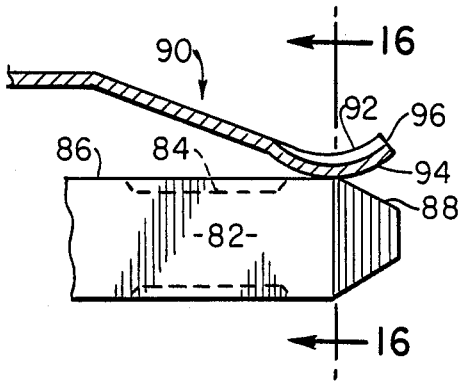
FIG. 15 is a fragmentary side elevation view of a pair of electrical contacts formed in accordance with a fourth embodiment of the present invention, the contacts being only partially engaged.
Figure 16:
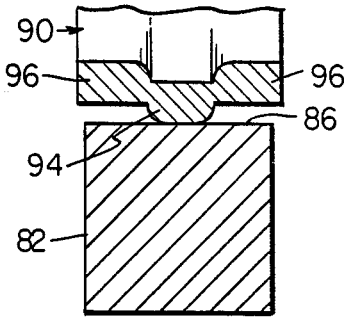
FIG. 16 is a sectional view of the embodiment shown in FIG. 15 viewed along the line 16—16 of FIG. 15.

During initial engagement of the contacts, as illustrated in FIGS. 15 and 16, the mid-section 94 of the leaf contact rides on the unrecessed top surface 86 of the pin and keeps the legs 96 elevated from the pin's surface.

Figure 17:
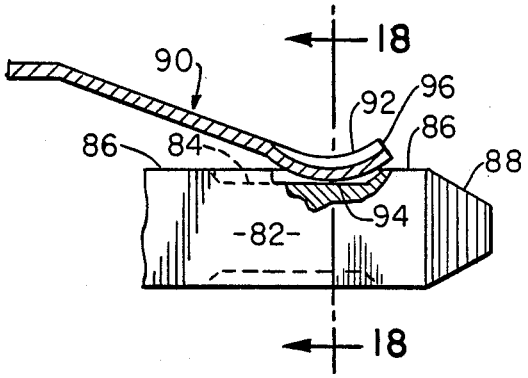
FIG. 17 is a side elevation view of the embodiment shown in FIG. 15, further illustrating the interaction of the two contacts, when fully engaged.
Figure 18:
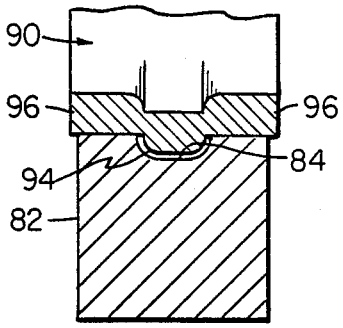
FIG. 18 is a sectional view of the embodiment of FIG. 15 viewed along the line 18—18 of FIG. 17.

When the two contacts are fully engaged, as shown in FIGS. 17 and 18, the mid-section 94 of the leaf contact is received by the pin recess 84 so that the legs 96 of the leaf contact drop into contact with the top surface 86 of the pin on opposite sides of pin recess 84.

A further embodiment of the present invention is illustrated in FIGS. 19–22 of the drawings. Here, the resilient contact 100 has a main body portion 102 and an upturned leading portion 104 forming the free end of the resilient contact, joined to the main body portion 102 by a curved portion 105. The upturned leading portion 104 has a protruding center strip 106 (which may be stamped out from the leading portion 102) and which extends below the bottom surface of the resilient contact.

Figure 20:
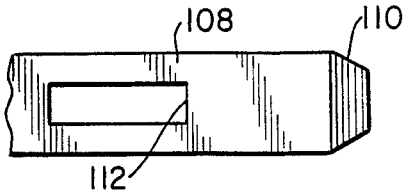
FIG. 20 is a plan view of another contact designed to mate with that illustrated in FIG. 19.

The mating pin 108 has a square cross-sectional shape, and has a tapered tip 110 which engages the center strip 106 when the connector is being coupled. The pin 108 is formed with a central opening in the form of a depression located centrally in its top surface and spaced from the pin tip 110. Alternatively, as is illustrated in FIG. 20, the pin 108 may include a central opening 112 in the form of a hole extending entirely through its thickness and which is similarly spaced from the pin tip 110. The central opening 112 should have a depth and width of sufficient dimension to entirely receive the center strip 106 of the resilient contact 102.

Figure 21:
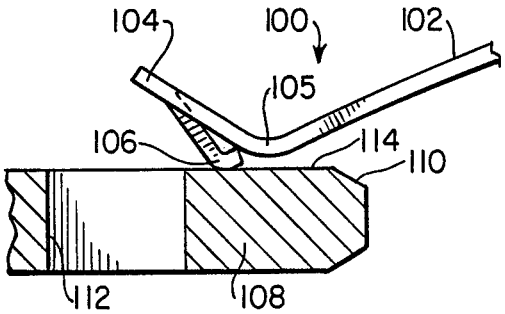
FIG. 21 is a side elevation view of the two contacts illustrated in FIGS. 19 and 20 and illustrating their interaction when partially engaged.
Figure 22:
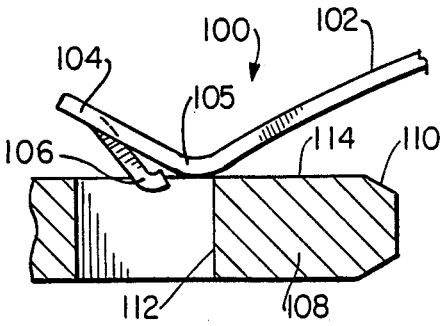
FIG. 22 is a side elevation view similar to that shown in FIG. 21 and further illustrating the interaction of the two contacts when fully engaged.

As illustrated in FIG. 21, as the two connector assemblies are being coupled together, the center strip 106 of the resilient contact 102 rides along the top surface 114 of the end portion of the pin 108. The center strip 106 thus acts to keep the curved portion 105 of the resilient contact 102 elevated from the surface of the pin 108.

When the two connector assemblies are about to become entirely engaged, the center strip 106 enters the central opening 112 formed in the pin 108. This permits the resilient contact 102 to drop toward the pin 108, with the curved portion 105 resting on the surface of the pin 108 on either side of the central opening 112. Because abrasion only occurs at the center strip 76 of the resilient contact and at a central portion of the end 114 of the pin 108, a good conductive path is provided between the curved portion 105 of the resilient contact and the top surface of the pin 108 on which the curved portion 105 rests.

As with the previous embodiments, only the electrical contacting portion of either contact need be coated with noble metal for extended life; that is, only the curved portion 105 of the resilient contact and the surfaces of the pin 108 on opposite sides of the central opening 112 need be so coated, again economizing on noble metal, which is shielded from abrasion by the configuration of the contacts.

The present invention is not restricted to connectors having a pin assembly and a resilient contact assembly, but is adaptable for use with hermaphroditic contact connectors, in which the contacts for both connector assemblies are the same. This is shown in the further embodiment of the present invention illustrated in FIGS. 23–25 of the drawings.

Figure 23:
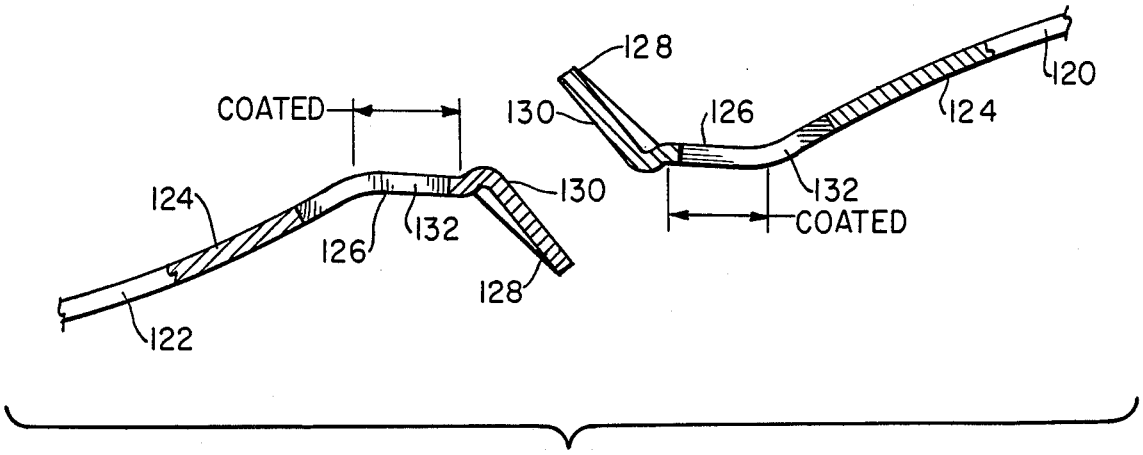
FIG. 23 is a side elevation view of a pair of mating hermophrodite contacts formed in accordance with a sixth embodiment of the present invention.

FIG. 23 shows a pair of mating hermaphroditic contacts 120,122 in accordance with present invention. Each contact has a free end extending from a respective connector assembly, which when mated cause the contacts to engage to complete an electrical path through the connector.

Each contact 120,122 includes a main body section 124 which may be mounted in the connector assembly, an intermediate section 126 obtusely angled from the main body portion 124, and a leading tip section 128 extending at an angle from the intermediate section 126. The tip section 126 includes a center strip 130 which projects outwardly from the surface of the tip section 128, in much the same way as the center strip 106 of the embodiment shown in FIG. 19.

The intermediate section 126 and a short part of the main body section 124 adjacent the intermediate section 126 include a central opening 132 formed through the thickness thereof, which is similar in many respects to the central opening 112 formed in the pin 108 illustrated in FIG. 21.

The actual electrical contacting surface is the portion of the intermediate section 126 on both sides of the central opening 132. When the two connector assemblies are being coupled together, the center strip 130 of one contact rides on the center strip 130 of the other, thereby keeping the electrical contacting surfaces separated.

Figure 25:
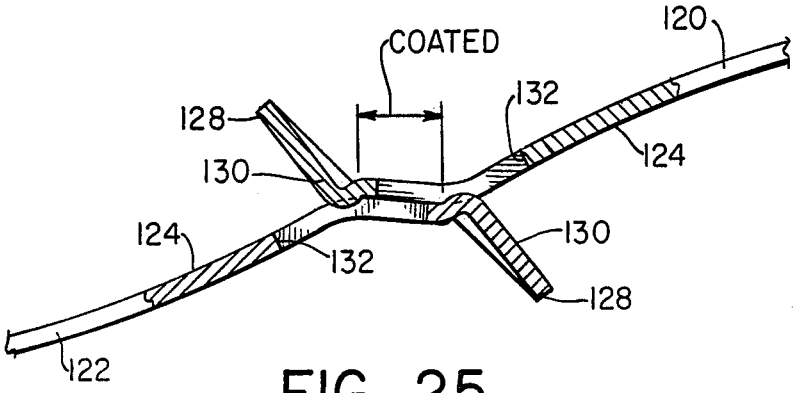
FIG. 25 is a side elevation view of the contacts illustrated in FIG. 23, further illustrating their interaction.

When the connector assemblies are fully engaged, as illustrated in FIG. 25, the center strips 130 are received in the openings 132 formed in the mating contact. When this occurs, the areas on each side of the central openings 132 of the intermediate section 126 contact each other substantially without any rubbing action, and provide a good electrical path through the connector while minimizing abrasion at the contacting areas.

Figure 26:
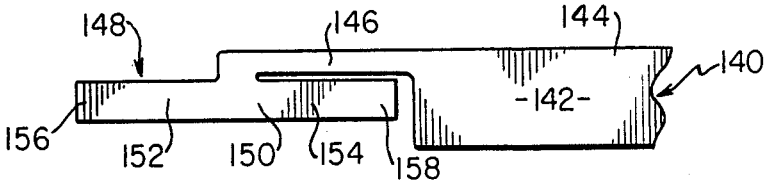
FIG. 26 is a top view of a blank from which an electrical contact of a pair of mating electrical contacts is formed in accordance with a seventh embodiment of the present invention.
Figure 27:
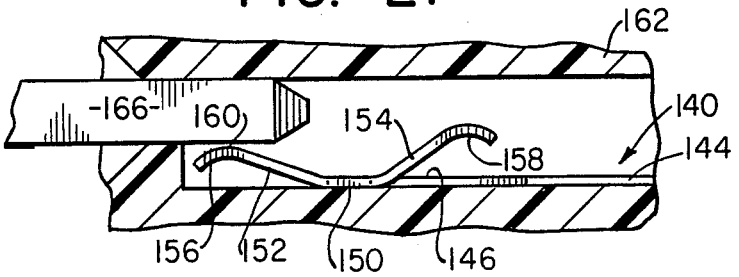
FIG. 27 is a fragmentary side elevation view of an electrical connector assembly formed in accordance with a seventh embodiment of the present invention, illustrating the position of the contacts during engagement.
Figure 28:
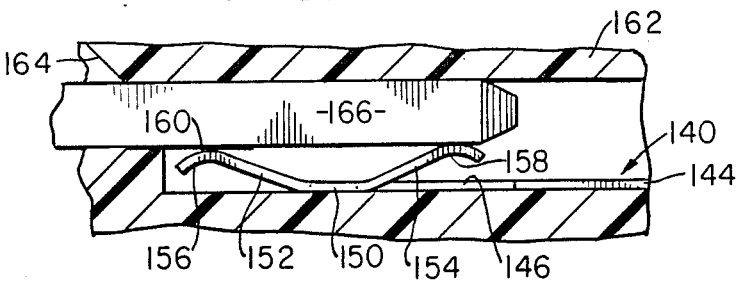
FIG. 28 is a side elevation view of the connector assembly shown in FIG. 27, illustrating the interaction of the contacts of the connector at final engagement in accordance with the present invention.

A further variation of the present invention is illustrated in FIGS. 26–28. A resilient contact member 40 is formed by first precision stamping a blank 142 to define a main body 144, a neck 146 extending longitudinally of the body 148 and having a narrower width than the body, and a head portion 148 joined at its mid-section 150 to one end of the neck 146. The head portion 148 is bent upwardly on both sides of its mid-section 150 out of the plane in which the stamped blank resides. Thus, a first rocker arm 152 and a second rocker arm 154 are defined by the bent head portion and mutually diverge at an obtuse angle.

Each rocker arm 152,154 is thus formed as a resilient leaf, and may include a slightly curved, free standing end 156,158. As will become more apparent, the curved end 156 of the first arm constitutes an electrical contacting surface which may be coated with a noble metal (such as at 160), while the curved end 158 of the second rocker arm constitutes a bearing surface.

The leaf contact 140 may be enclosed in a housing 162, as illustrated in FIGS. 27 and 28. The housing 162 preferably includes a countersunk opening 164 to facilitate insertion of the pin contact 166.

As shown in FIG. 27, the second rocker arm 154 is normally biased to lie within the axial path of the pin contact 166 (received through the opening 164), and the first rocker arm 152 is biased below the pin's axial path so that it does not contact the pin during initial engagement.

The particular configuration of the stamped blank and its thickness allows the rocker arms 152,154 to pivot about the mid-section 150 of the head portion. Thus, when the pin 166 is fully inserted into the housing 162, it contacts the curved tip 158 of the second rocker arm 154 and forces the arm downwardly out of its path. This action biases the first rocker arm 152 upwardly so that its curved tip 156 engages a surface of the pin's shank, such as at 168, which coated with a noble metal.

It should be noted that the pivoting action of the rocker arms 152,154 will occur without the support of the housing 162 if the body 142 and neck 146 of the stamped blank are dimensioned in thickness and width to remain substantially rigid and to provide sufficient support for the movement of the rocker arms without deflecting during engagement with the pin.

Figure 29:
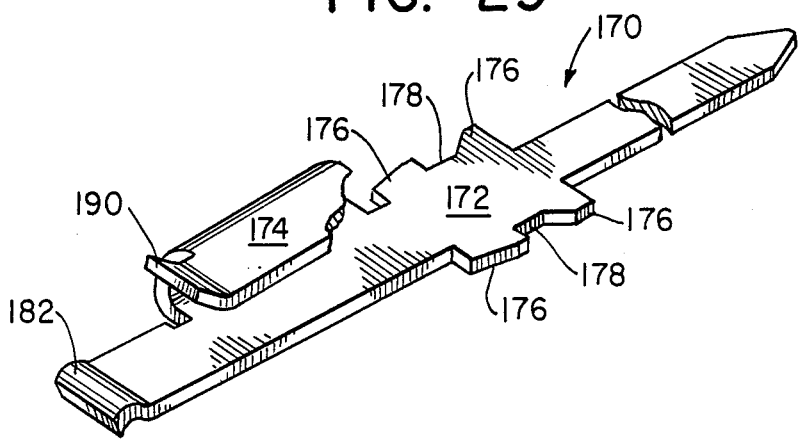
FIG. 29 is an isometric view of one electrical contact of a pair of mating electrical contacts formed in accordance with an eighth embodiment of the present invention.
Figure 30:
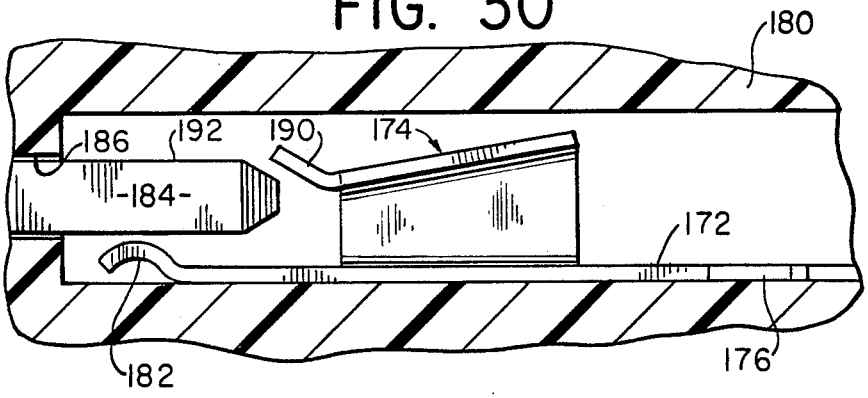
FIG. 30 is a fragmentary side elevation view of an electrical connector assembly formed in accordance with an eighth embodiment of the present invention, incorporating the contact shown in FIG. 29, and illustrating the position of mating contacts during engagement.
Figure 31:
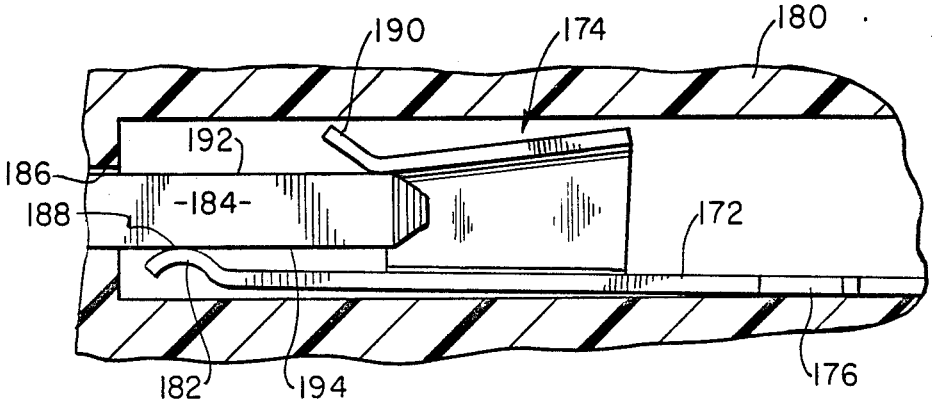
FIG. 31 is a side elevation view of the connector assembly shown in FIG. 30, further illustrating the interaction of the contacts, when fully engaged.

A further embodiment of the present invention is shown in FIGS. 29–31. A resilient leaf contact 170 is formed by precision stamping and shaping a blank into the configuration shown in FIG. 29. The leaf contact 170 includes a substantially flat, resilient lower plate 172 and an upper plate 174 formed from a lateral extension of the lower plate 170 which is folded to overlie a portion of the lower plate. Locking tabs 176 extend from the lateral edges of the lower plate 172 and may engage a projection (not shown) which is formed in a housing 180 and which conforms to the recess 178 between adjacent tabs 176, in order to secure the resilient leaf contact 170 to the assembly. Contact 170 may also be retained by force fitting the contact into housing 180, where tabs 176 act as barbs which engage the housing walls.

The leading edge 182 of the lower plate 172 is curved to protrude upwardly from its overall flat shape to form a transversely extending ridge. This leading edge 182 provides an electrical contacting surface and may be coated with a precious metal. In the contact's unbiased position, the leading edge 182 resides outside of the axial path of a mating pin contact 184, illustrated in FIG. 30 as entering housing 180 through an opening 186 formed therein.

The upper plate 174 is set inwardly on the resilient leaf contact from the longitudinal end or leading edge 182 of the lower plate a predetermined distance. This distance will correspond approximately to the distance that the electrical contacting surface area 188 on the pin contact is set in from the pin contact's tip.

The longitudinal end or leading edge 190 of the upper plate 174 is flared upwardly and away from the lower plate 172. This flared portion of the leading edge constitutes a bearing surface that cooperates with the pin contact 184 of the mating connector assembly.

As shown in FIG. 30, the pin contact 184 and resilient leaf contact 170 are aligned so that the tip of the pin engages the flared leading edge 190 of the upper plate 174, causing the upper plate 174 to ride on the top surface 192 of the pin. The deflection of the upper plate 174 biases the resilient lower plate 172 toward the bottom surface 194 of the pin so that the curved leading edge 182 contacts the electrical contacting surface area 188 of the pin, as illustrated in FIG. 31.

It will be appreciated that variations may be made in the structure of the contacts described herein which provide an electrical contacting surface and a bearing surface which protects the electrical contacting surface when the connector assemblies are coupled and uncoupled. For example, instead of a single central opening 112 formed in the pin 108 as illustrated in FIG. 21, the lateral side walls of the pin may be cut away to provide a narrow central raised portion, and correspondingly, rather than provide a single center strip on the upturned portion of the resilient arm illustrated in FIG. 19, a pair of side by side strips may be provided on that portion. The strips of the resilient contact would then be received by the recesses formed in the sides of the pin to provide an electrical path through the surfaces of the pin and resilient contact residing between the recesses and lateral strips.

Figure 24:
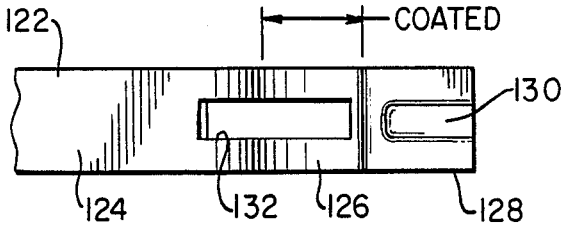
FIG. 24 is a plan view of one of the hermophrodite contacts illustrated in FIG. 23.

Likewise, with the embodiment illustrated in FIGS. 23–25, a pair of lateral strips may project from the tip portions of each contact to be received by side recesses or notches formed in the intermediate section of the other contact.

The electrical connector formed in accordance with the present invention avoids many of the drawbacks apparent with connectors currently on the market today. By separating the mechanical function of mating corresponding contacts (with good resiliency to hold them together) from the electrical function of providing a good electrical path through the contacts, an extended connect/disconnect cycle life can be achieved.

Although the illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. An electrical connector which comprises:

a pair of mating connctor assemblies, each of which is adapted for sliding engagement with the other, to form an electrically conductive path from one assembly to the other;

one of said assemblies comprising a substantially rigid member, each of the substantially rigid member and resilient leaf member being electrical conductive;

said substantially rigid member and resilient leaf member being positioned in their respective connector assemblies to contact each other upon the coupling of said connector assemblies thereby providing an electrically conductive path through the connector;

the resilient leaf member being biased toward the substantially rigid member so as to be adapted to slidably engage the substantially rigid member during the coupling and uncoupling of said connector assemblies;

each of the substantially rigid member and resilient leaf member including a bearing surface upon which the other of the substantially rigid member and resilient leaf member slides during the coupling and uncoupling of the connector assemblies, and also including an electrical contacting surface area;

the edges of said resilient member being bent out of the plane thereof over a region spaced longitudinally from the electrical contacting surface area thereof, to form a pair of mutually diverging legs, said legs being adapted to cooperate with and rest on the bearing surface of the substantially rigid member to prevent contact between the electrical contacting surface area of the resilient member and the electrical contacting surface area and bearing surface of the substantially rigid member and also to prevent contact between the electrical contacting surface area of the substantially rigid member and the bearing surface of the resilient member, during the coupling and uncoupling of the connector assemblies;

the substantially rigid member having chamfered edges over a region at the bearing surface thereof and spaced longitudinally from the contacting surface thereof and adapted to receive the legs of the resilient member to allow the surface of the substantially rigid member to be more closely approached by said legs of the resilient member thereby causing the electrical contacting surface areas of the resilient member and substantially rigid member to engage each other upon the substantially complete coupling of the connector assemblies.

2. An electrical connector as defined in claim 1 wherein the resilient member further includes a curved portion protruding from the same surface as the bearing surface and is positioned thereon at the electrical contacting surface area.

3. An electrical connector which comprises:

a pair of mating connector assemblies, each of which is adapted for sliding engagement with the other, to form an electrically conductive path from one assembly to the other;

one of said assemblies comprising a substantially rigid member, and the other of said assemblies comprising a resilient leaf member, each of the substantially rigid member and resilient leaf member being electrically conductive;

said substantially rigid member and resilient leaf member being positioned in their respective connector assemblies to contact each other upon the coupling of said connector assemblies thereby providing an electrically conductive path through the connector;

the resilient leaf member being biased toward the substantially rigid member so as to be adapted to slidably engage the substantially rigid member during the coupling and uncoupling of said connector assemblies;

each of the substantially rigid member and resilient leaf member including a bearing surface upon which the other of the substantially rigid member and resilient leaf member slides during the coupling and uncoupling of the connector assemblies, and also including an electrical contacting surface area;

the substantially rigid member being of substantially uniform width and including a pair of recessed lateral surfaces formed adjacent but longitudinally spaced from its bearing surface;

the resilient member including a mid-section and having its edges bent to form a pair of depending legs joined to opposite sides of the mid-section, the ends of the legs being displaced from the mid-section so as to be adapted to cooperate with and rest on the bearing surface of the substantially rigid member to prevent contact between the mid-section of the resilient member and the bearing surface and electrical contacting surface area of the substantially rigid member, during the coupling and uncoupling of the connector assemblies, and to cooperate with the recessed lateral surfaces of the substantially rigid member to allow the mid-section of the resilient member to contact the electrical contacting surface area of the substantially rigid member upon the substantially complete coupling of the connector assembly.

4. An electrical connector which comprises:

a pair of mating connector assemblies, each of which is adapted for sliding engagement with the other, to form an electrically conductive path from one assembly to the other;

one of said assemblies comprising a substantially rigid member, and the other of said assemblies comprising a resilient leaf member, each of the substantially rigid member and resilient leaf member being electrically conductive;

said substantially rigid member and resilient leaf member being positioned in their respective connector assemblies to contact each other upon the coupling of said connector assemblies thereby providing an electrically conductive path through the connector;

the resilient leaf member being biased toward the substantially rigid member so as to be adapted to slidably engage the substantially rigid member during the coupling and uncoupling of said connector assemblies;

each of the substantially rigid member and resilient leaf member including a bearing surface upon which the other of the substantially rigid member and resilient leaf member slides during the coupling and uncoupling of the connector assemblies, and also including an electrical contacting surface area;

the substantially rigid member including a recess formed contrally over a portion of its bearing surface;

the resilient member including a mid-section and a pair of legs joined to opposite sides of the mid-section, the legs being displaced from the mid-section in a direction away from said substantially rigid member so that the mid-section is adapted to cooperate with and rest on the bearing surface of the substantially rigid member to prevent contact between the legs of the resilient member and the bearing surface of the substantially rigid member, during the coupling and uncoupling of the connector assemblies, and to cooperate with and be received by the central recess of the substantially rigid member to allow the legs of the resilient member to contact the electrical contacting surface area of the substantially rigid member upon the substantially complete coupling of the connector assembly.

5. A connector comprising:

a pair of electrically conductive contact members, one contact member of said pair being resilient, and the other contact member of said pair being substantially rigid;

said contact members being adapted for slidable engagement one with the other, with said resilient contact member resiliently urging said members toward one another during said engagement;

each of said contact members having an electrical contacting area;

the resilient contact member including a substantially flat, resilient lower plate, and further including means for maintaining said electrical contacting areas out of contact with one another during the engaging of the resilient contact member with the substantially rigid contact member until said engagement is substantially complete, and for causing said contact areas to be in electrical contact when said contact members are in substantially complete engagement;

said means including an upper plate at least partially overlying the lower plate and operatively linked thereto to cause said lower plate to move from a first position, in which the lower plate is out of contact with the substantially rigid member, to a second position, in which the lower plate is in contact with the substantially rigid member, when the substantially rigid member contacts the upper plate.

6. A resilient contact member of an electrical connector assembly, which comprises:

a substantially flat, resilient lower plate, the lower plate including an electrical contacting surface; and an upper plate at least partially overlying the lower plate, the upper plate including a bearing surface and being joined to the lower plate so as to be adapted when contacted on its bearing surface by a substantially rigid contact member of a mating connector assembly to resiliently urge the electrical contacting surface of the lower plate into contact with the substantially rigid member.

7. A resilient contact member as defined by claim 6, wherein the bearing surface of the upper plate is situated near a longitudinal end of the upper plate, said longitudinal end being flared upwardly and away from the lower plate.

8. A resilient contact member as defined by claim 6, wherein the electrical contacting surface of the lower plate is situated near a longitudinal end of the lower plate, said longitudinal end including a ridge extending transversely to the lower plate.

9. A resilient contact member as defined by claim 6, wherein the lower plate includes at least one tab extending laterally therefrom for mounting the resilient contact member in a connector assembly.

10. A resilient contact member as defined by claim 6, wherein the upper and lower plates are integrally formed, the upper plate being formed as a bent lateral extension of the lower plate.

* * * * *